US012704322B2

(12) United States Patent
Leclerc

(10) Patent No.: US 12,704,322 B2
(45) Date of Patent: Aug. 11, 2026

(54) PROCESS AND APPARATUS FOR LIQUEFACTION OF $CO_2$

(71) Applicant: L'Air Liquide, Societe Anonyme pour l'Etude et l'Exploitation des Procedes Georges Claude, Paris (FR)

(72) Inventor: Mathieu Leclerc, Champigny-sur-Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 186 days.

(21) Appl. No.: 18/800,339

(22) Filed: Aug. 12, 2024

(65) Prior Publication Data

US 2026/0043605 A1 Feb. 12, 2026

(51) Int. Cl.
*F25J 1/00* (2006.01)
*F25J 1/02* (2006.01)

(52) U.S. Cl.
CPC ..... *F25J 1/0027* (2013.01); *F25J 1/0032* (2013.01); *F25J 1/0279* (2013.01)

(58) Field of Classification Search
CPC ... A61B 1/00149; A61B 1/0016; A61B 1/042; F25J 1/0027; F25J 1/0032; F25J 1/0045; F25J 1/0052; F25J 1/0208; F25J 1/0262; F25J 1/0279; F25J 2270/90; F25J 2290/32
See application file for complete search history.

(56) References Cited

U.S. PATENT DOCUMENTS

| | | | | |
|---|---|---|---|---|
| 7,201,019 | B2 * | 4/2007 | Howard | F25J 3/061 62/928 |
| 10,317,111 | B2 * | 6/2019 | Briglia | F17C 13/021 |
| 11,965,694 | B2 * | 4/2024 | Cortale | F25J 3/0252 |
| 2004/0040715 | A1 * | 3/2004 | Wellington | E21B 43/24 166/302 |
| 2008/0256959 | A1 * | 10/2008 | Aspelund | F17C 9/00 62/50.7 |
| 2009/0120780 | A1 * | 5/2009 | Wegerer | C07C 7/04 202/158 |
| 2015/0047390 | A1 * | 2/2015 | Darde | F25J 3/0266 62/617 |
| 2015/0114032 | A1 * | 4/2015 | Higginbotham | F25J 1/0027 62/606 |
| 2018/0209726 | A1 * | 7/2018 | Caruso | F25J 3/0295 |
| 2018/0251373 | A1 * | 9/2018 | Fernandez | C01B 3/508 |
| 2019/0271503 | A1 * | 9/2019 | Terrien | C10L 3/101 |
| 2020/0191477 | A1 * | 6/2020 | Mak | F25J 1/0022 |
| 2021/0055048 | A1 * | 2/2021 | Hernandez | F25J 3/0233 |
| 2022/0163257 | A1 * | 5/2022 | Pierce | F25J 3/0209 |

* cited by examiner

*Primary Examiner* — Filip Zec
(74) *Attorney, Agent, or Firm* — Allen E. White; Elwood L. Haynes

(57) ABSTRACT

In a process of liquefaction and subcooling of a stream rich in $CO_2$, the stream is liquefied by a closed cycle of refrigerant and subcooled by heat exchange with three streams of liquid $CO_2$ at different pressures.

13 Claims, 1 Drawing Sheet

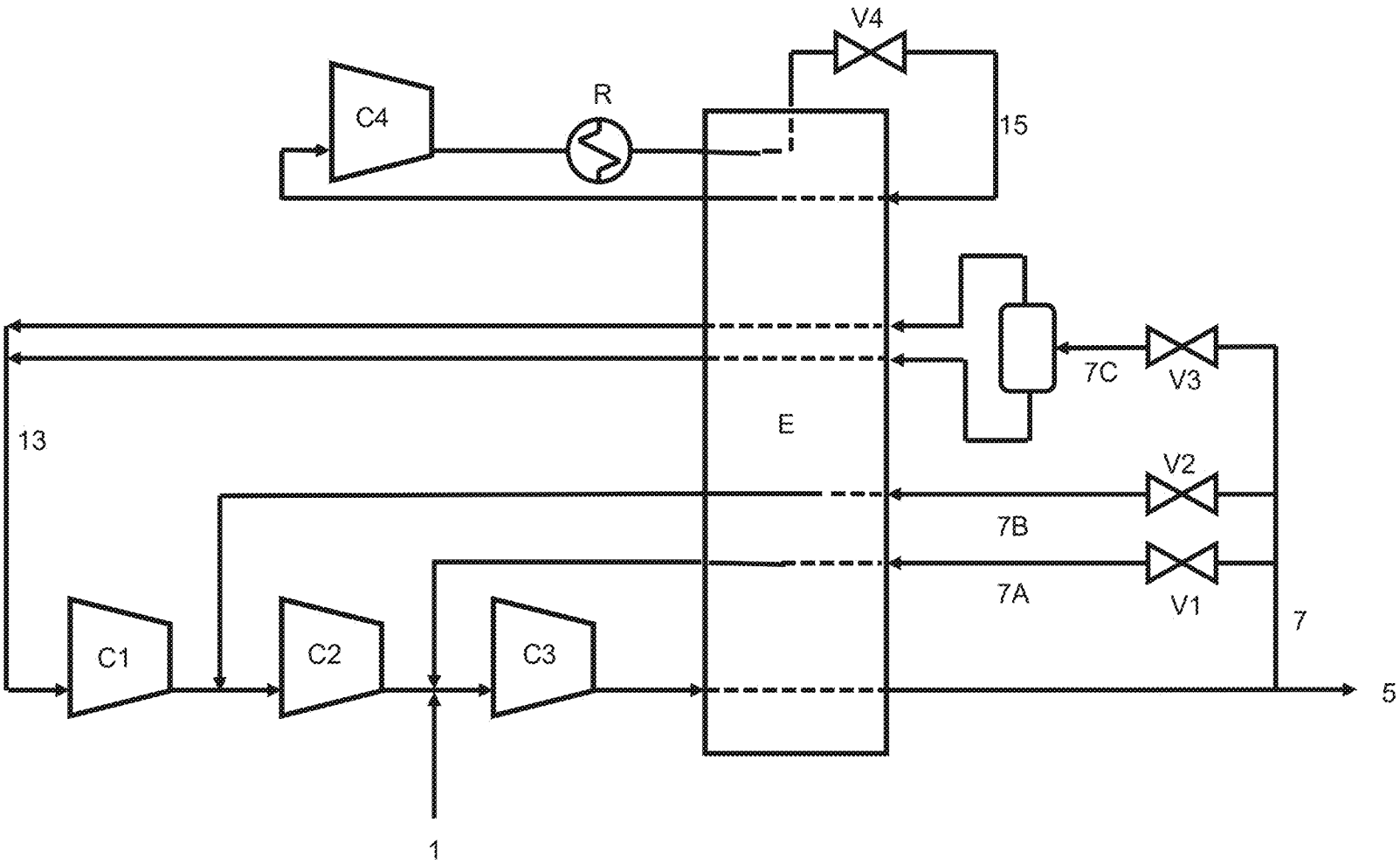
V4
15
R
C4
E
V3
7C
V2
7B
V1
7A
7
5
C3
C2
C1
1
13

PROCESS AND APPARATUS FOR LIQUEFACTION OF $CO_2$

BACKGROUND

The present invention relates to a process and an apparatus for liquefying $CO_2$. Compression and liquefaction typically represent a significant energy cost in the $CO_2$ capture, transport and sequestration chain. Optimizing this step is therefore key in order to optimize the overall costs of this infrastructure.

$CO_2$ liquefaction cycles can be classified into three main groups:

1. Compression of $CO_2$ up to an intermediate pressure (20-30 bara) allowing it to liquefy at the temperature generated by the expansion (up to a pressure close to atmospheric pressure) of an external refrigerant ($NH_3$ for example) and liquefaction against this refrigerant which vaporizes, itself being recompressed, condensed and expanded forming a closed refrigeration cycle. The desired final $CO_2$ pressure is most often lower than the liquefaction pressure, the $CO_2$ is therefore expanded. The $CO_2$ vaporized during this expansion is then recompressed in a $CO_2$ compressor and mixed with the input $CO_2$ to be liquefied.
2. Compression of $CO_2$ up to a high pressure (60-100 bara) allowing it to liquefy (or increase its density) against a cold source close to ambient temperature (refrigeration water or ambient air for example). The liquid (or dense) $CO_2$ obtained is subcooled before being expanded. Subcooling is achieved by part of the liquid obtained being expanded and revaporized at different pressure levels. This $CO_2$ is recompressed in the $CO_2$ compressor with the input $CO_2$. This process makes it possible to limit the quantity of $CO_2$ circulating in a loop because the quantity vaporized is reduced thanks to subcooling.
3. Combination of the preceding processes (cascade of external refrigerant and $CO_2$): Compression of the $CO_2$ up to an intermediate pressure allowing it to liquefy at the temperature generated by the expansion (up to a pressure close to atmospheric pressure) of a external refrigerant ($NH_3$ for example), liquefaction thanks to the external refrigerant and under cooling thanks to a part of the $CO_2$ obtained, vaporized and recycled. The invention makes it possible to improve the energy spent by the $CO_2$ and external refrigerant compressors.

It also makes it possible to reduce the investment costs of the liquefier compressors and to simplify the refrigeration cycle machine, for example $NH_3$.

The inventory quantities of external refrigerant (liquid in particular) in the process are also reduced which is a significant improvement in terms of safety and with respect to environmental permit constraints when this refrigerant is toxic and/or flammable as ammonia.

SUMMARY

A process for the liquefaction and subcooling of a stream rich in $CO_2$ containing at least 95 mol % of carbon dioxide including the following steps. Liquefaction of the stream rich in $CO_2$ at a subcritical pressure greater than 48 bars abs, through an indirect heat exchange in a heat exchanger having a hot end and a cold end with an at least partially liquid stream of a refrigerant different from $CO_2$ at a first pressure greater than 4 bara in which the liquid stream of refrigerant different from $CO_2$ vaporizes to form a gaseous stream of refrigerant different from $CO_2$ at the first pressure and the $CO_2$-rich stream liquefies to form a $CO_2$-rich liquid stream at a subcritical pressure Subcooling of the $CO_2$-rich liquid stream or of a fluid formed by separating the $CO_2$-rich liquid stream, through indirect heat exchange in the heat exchanger with at least three other liquid streams rich in $CO_2$ which each vaporize at a different pressure, therefore at at least three different pressure levels. Compression of the gaseous stream of refrigerant different from $CO_2$ or of a stream formed by separating this gaseous stream, the compression taking place in a compressor from the first pressure to a second pressure greater than the first pressure in order to obtain a gas stream of refrigerant different from $CO_2$, at the second pressure in a single compression stage, no gas flow being sent to an intermediate level of the compressor. Condensation of the gaseous stream of refrigerant different from $CO_2$ at the second pressure or of a stream resulting therefrom in order to obtain a liquid stream of ammonia at the second pressure. Cooling of the refrigerant liquid stream to the second pressure in the heat exchanger. And expansion either of the cooled liquid stream of refrigerant different from $CO_2$ at the second pressure or of a stream formed by separating the liquid stream of refrigerant different from $CO_2$ up to the first pressure in order to obtain the at least partially liquid stream of refrigerant different from $CO_2$ up to a single pressure which is the first pressure.

An apparatus for liquefying and subcooling a stream rich in $CO_2$ containing at least 95 mol % of carbon dioxide comprising a heat exchanger having a hot end and a cold end, a means for sending the stream rich in $CO_2$ at a subcritical pressure greater than 48 bar abs, liquefy through indirect heat exchange in the heat exchanger with an at least partially liquid stream of a refrigerant different from $CO_2$ at a first pressure greater than 4 bara in which the liquid stream of refrigerant different from $CO_2$, vaporizes to form a gaseous stream of refrigerant different from $CO_2$ at the first pressure and the stream rich in $CO_2$ liquefies to form a $CO_2$-rich liquid stream at subcritical pressure, a means for subcooling the $CO_2$-rich liquid stream or a fluid formed by separating the $CO_2$-rich liquid stream, through an exchange of indirect heat in the heat exchanger with at least three other liquid streams rich in $CO_2$ which each vaporize at a different pressure, therefore at at least three different pressure levels, a compressor for compressing the gaseous stream of refrigerant different from $CO_2$ or a stream formed by separating this gaseous stream, the compression taking place in the compressor from the first pressure to a second pressure greater than the first pressure in order to obtaining a gas stream of refrigerant different from $CO_2$ at the second pressure in a single compression step, no gas flow being sent to an intermediate level of the compressor, a means for condensing the gas stream of refrigerant different from $CO_2$ at the second pressure or a current coming from it in order to obtain a liquid stream of ammonia at the second pressure, a means for sending the liquid stream of condensed refrigerant at the second pressure to cool in the exchanger heat and a means for expanding either the cooled liquid stream of refrigerant different from $CO_2$ to the second pressure or a stream formed by separating the liquid stream of refrigerant different from $CO_2$ to the first pressure in order to obtain the at least partially liquid stream of refrigerant different from $CO_2$ up to a single pressure which is the first pressure.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein:

FIG. 1 is a schematic representation of a device for liquefying and subcooling a stream rich in $CO_2$, in accordance with one embodiment of the present invention.

DESCRIPTION OF PREFERRED EMBODIMENTS

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

According to one object of the invention, there is provided a process for liquefaction and subcooling of a stream rich in $CO_2$ containing at least 95 mol % of carbon dioxide containing the following steps:

i) liquefaction of the stream rich in $CO_2$ at a subcritical pressure but greater than 48 bars abs, thanks to an indirect heat exchange in a heat exchanger having a hot end and a cold end with an at least partially liquid stream of a refrigerant, for example ammonia, at a first pressure greater than 4 bara in which the liquid stream of refrigerant, for example ammonia vaporizes to form a gaseous stream of refrigerant, for example ammonia at the first pressure and the rich stream in $CO_2$ liquefies to form a liquid stream rich in $CO_2$ at a subcritical pressure and ii) subcooling of the $CO_2$-rich liquid stream or of a fluid formed by separating the $CO_2$-rich liquid stream, through indirect heat exchange in the heat exchanger with at least three other $CO_2$-rich liquid streams which each vaporize at a different pressure, therefore at least three pressure levels iii) compression of the gaseous stream of refrigerant, for example ammonia or of a stream formed by separating this gaseous stream, the compression taking place in a compressor from the first pressure to a second pressure greater than the first pressure in order to obtain a gas stream of refrigerant, for example ammonia, at the second pressure in a single compression stage, no gas flow being sent to an intermediate level of the compressor iv) condensation of the gaseous stream of refrigerant, for example of ammonia at the second pressure or of a stream resulting therefrom in order to obtain a liquid stream of ammonia at the second pressure v) cooling of the refrigerant liquid stream to the second pressure in the heat exchanger and vi) expanding either the cooled liquid stream of refrigerant, for example ammonia, to the second pressure or a stream formed by separating the liquid stream of refrigerant, for example ammonia, to the first pressure in order to obtain the current at least partially refrigerant liquid, for example ammonia, up to a single pressure which is the first pressure.

According to other optional characteristics:

the first pressure is greater than 5 bara.

the gas stream rich in $CO_2$ condenses at a temperature between 5 and 15° C.

the refrigerant flows in a closed loop and the refrigerant compressor inlet temperature is the temperature at which the refrigerant, for example ammonia exits the hot end of the heat exchanger.

the gaseous stream of refrigerant, for example ammonia, leaves the compressor and enters the hot end of the heat exchanger after having been condensed against air or water.

a portion of the $CO_2$-rich liquid stream at subcritical pressure is expanded to form the at least three $CO_2$-rich liquid streams vaporizing at at least three pressure levels.

at least one stream of liquid $CO_2$ vaporizing at at least one pressure level enters the cold end of the heat exchanger.

the expanded liquid refrigerant is at an intermediate temperature of the heat exchanger.

The expanded liquid refrigerant is sent to heat in the heat exchanger at an intermediate point between the cold end and the hot end of the heat exchanger.

the refrigerant compressor has only one compression section.

the inlet pressure of the refrigerant compressor is greater than 4 bara, or even 5 bara.

the refrigerant remains entirely in liquid form after the expansion step vi).

According to another object of the invention, there is provided an apparatus for liquefying and subcooling a stream rich in $CO_2$ containing at least 95 mol % of carbon dioxide comprising a heat exchanger having a hot end and a hot end. cold, means for sending the stream rich in $CO_2$ at a subcritical pressure but greater than 48 bars abs, to liquefy thanks to an indirect heat exchange in the heat exchanger with an at least partially liquid stream of a refrigerant, for example ammonia, at a first pressure greater than 4 bara in which the liquid stream of refrigerant, for example ammonia vaporizes to form a gaseous stream of refrigerant, for example ammonia at the first pressure and the rich stream in $CO_2$ liquefies to form a liquid stream rich in $CO_2$ at a subcritical pressure, means for subcooling the liquid stream rich in $CO_2$ or a fluid formed by separating the liquid stream rich in $CO_2$, thanks to an indirect heat exchange in the heat exchanger with at least three other liquid streams rich in $CO_2$ which each vaporize at a different pressure, therefore at at least three pressure levels, a compressor to compress the gaseous stream of refrigerant, for example of ammonia or of a stream formed by separating this gaseous stream, the compression taking place in the compressor from the first pressure to a second pressure greater than the first pressure in order to obtain a gaseous stream of refrigerant, for example ammonia, at the second pressure in a single compression stage, no gas flow being sent to an intermediate level of the compressor, means for condensing the gas stream of refrigerant, for example ammonia at the second pressure or a current coming from it in order to obtain a liquid stream of ammonia at the second pressure, means for sending the liquid stream of condensed refrigerant at the second pressure to cool in the heat exchanger and means for expanding either from the cooled liquid stream of refrigerant, for example ammonia at the second pressure or from a stream formed by separating the liquid stream of refrigerant, for example ammonia, up to the first pressure in order to obtain the current at less partially refrigerant liquid, for example ammonia, up to a single pressure which is the first pressure.

The invention will be described in more detail with reference to the FIGURE where in FIG. 1 represents a process according to the invention. In FIG. 1, a device for liquefying and subcooling a stream rich in $CO_2$ 1 containing at least 95 mol % of carbon dioxide comprises a heat exchanger E having a hot end and a cold end of type brazed plate and fin exchanger. The exchanger E can consist of a series of heat exchangers. The apparatus comprises means for sending the stream rich in $CO_2$ 1 at a subcritical pressure (for example between 45 and 53 bars, for example 50 bars) to the hot end of the exchanger E for indirect heat exchange with a single stream at least partially liquid 15 of ammonia at a first pressure greater than 4 bara or 5 bara. The at least partially liquid stream of ammonia vaporizes in the heat exchanger to form a gaseous stream of ammonia at the first pressure and the stream rich in $CO_2$ liquefies at a temperature between 5 and 15° C. to form a liquid stream rich in $CO_2$ at a subcritical pressure. Then the liquefied current continues to circulate in the heat exchanger E where it subcools, for example to a temperature of between −45° C. and −55° C., for example −50° C., thanks to an indirect heat exchange with at least three other liquid streams rich in $CO_2$ 7A, 7B, 11 which vaporize at at least three pressure levels.

The liquid streams rich in $CO_2$ 7A, 7B, 11 are formed by taking part of the liquid rich in $CO_2$ which has liquefied and subcooled in the exchanger E, by dividing it into at least three fractions, here three fractions, each of which is expanded in one of the valves V1, V2, V3 at a different pressure. The remainder of the liquid rich in liquefied and subcooled $CO_2$ constitutes the product of the process.

The gaseous stream of ammonia 15 leaving the hot end of the heat exchanger E is compressed in a compressor C4, for example with a single compression section, from the first pressure greater than 4 bara or 5 bara up to a second pressure greater than the first pressure in order to obtain a gaseous stream of ammonia 17 at the second pressure.

The gaseous stream 17 of ammonia is condensed in a condenser R at the second pressure against air or water then cooled in the heat exchanger E at the second pressure in order to obtain a liquid stream of ammonia at the second pressure which is withdrawn from the heat exchanger at the cold end.

The liquid ammonia stream 19 is expanded from the second pressure to the first pressure in a valve V4 in order to obtain the liquid ammonia stream at the first pressure which is returned to the heat exchanger E. The liquid current expanded in the valve V4 is sent to heat up at an intermediate point of the exchanger E between the cold end and the hot end thereof.

The liquid stream vaporizes at a single pressure which is the first pressure and then is sent to the suction of compressor C4.

The Invention Consists of:

- compress the gas rich in $CO_2$ to be liquefied 1 beyond the pressure necessary for its condensation against the external refrigerant, to approximately 50 bara for example
- liquefy the gas rich in $CO_2$ at moderate temperature (between 5 and 15° C., linked to the chosen pressure) against the refrigerant, for example ammonia, at a single level at intermediate pressure (5.5 bara for example, also linked to the pressure chosen for $CO_2$)
- sub-cool the gas rich in liquefied $CO_2$ between its liquefaction temperature and approximately −15° C. using a $CO_2$ level at intermediate pressure, for example approximately 30 bara
- sub-cool the gas rich in liquefied $CO_2$ to the required low temperature (approximately −50° C. for example) using at least two other vaporization stages.

In this way, the ammonia compressor C4 consists of only a single section without an intermediate inlet whose inlet pressure is relatively high (greater than 4 or 5 bara); its cost is therefore reduced.

The apparatus preferably does not include a phase separator for ammonia, particularly after expansion to the first pressure.

The refrigerant described in the example is ammonia but may be another suitable refrigerant.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A process for the liquefaction and subcooling of a stream rich in $CO_2$ containing at least 95 mol % of carbon dioxide comprising the following steps:

i. liquefying the stream rich in $CO_2$ at a subcritical pressure greater than 48 bars abs, through an indirect heat exchange in a heat exchanger having a hot end and a cold end with an at least partially liquid stream of a refrigerant different from $CO_2$ at a first pressure greater than 4 bara in which the liquid stream of refrigerant different from $CO_2$ vaporizes to form a gaseous stream of refrigerant different from $CO_2$ at the first pressure and the $CO_2$-rich stream liquefies to form a $CO_2$-rich liquid stream at a subcritical pressure, ii. subcooling the $CO_2$-rich liquid stream or a fluid formed by separating the $CO_2$-rich liquid stream, through indirect heat exchange in the heat exchanger with at least three other liquid streams rich in $CO_2$ which each vaporize at a different pressure, iii. compressing the gaseous stream of refrigerant different from $CO_2$ or a stream formed by separating said gaseous stream of refrigerant different from carbon dioxide, the compression taking place in a compressor from the first pressure to a second pressure greater than the first pressure in order to obtain a gas stream of refrigerant different from $CO_2$, at the second pressure in a single compression stage, no gas flow being sent to an intermediate level of the compressor iv. condensing the gaseous stream of refrigerant different from $CO_2$ at the second pressure or a stream resulting therefrom in order to obtain a liquid stream of ammonia at the second pressure v. cooling the refrigerant liquid stream to the second pressure in the heat exchanger and vi. expanding either the cooled liquid stream of refrigerant different from $CO_2$ at the second pressure or a stream formed by separating the liquid stream of refrigerant different from $CO_2$ up to the first pressure in order to obtain the at least partially liquid stream of refrigerant different from $CO_2$ up to a single pressure which is the first pressure.

2. The method according to claim 1 in which the first pressure is greater than 5 bara.

3. The method according to claim 1, in which the gas stream rich in $CO_2$ condenses at a temperature between 5° C. and 15° C.

4. The method according to claim 1, wherein the refrigerant circulates in a closed loop and the inlet temperature of the refrigerant compressor is the temperature at which the refrigerant different from $CO_2$ leaves the hot end of the heat exchanger.

5. The method according to claim 1, wherein the gaseous stream of refrigerant different from $CO_2$ leaves the compressor and enters the hot end of the heat exchanger after having been condensed against air or water.

6. The method according to claim 1, wherein a part of the liquid stream rich in $CO_2$ at a subcritical pressure is expanded to form the at least three other liquid streams rich in $CO_2$ vaporizing at at least three different pressure levels.

7. The method according to claim 1, wherein at least one stream of liquid $CO_2$ vaporizing at at least one pressure level enters the cold end of the heat exchanger.

8. The method according to claim 1, wherein the expanded liquid refrigerant is at an intermediate temperature of the heat exchanger.

9. The method according to claim 1, wherein the expanded liquid refrigerant is sent to heat up in the heat exchanger at an intermediate point between the cold end and the hot end of the heat exchanger.

10. The method according to claim 1, wherein the refrigerant compressor comprises only a single compression section.

11. The method according to claim 1, wherein the inlet pressure of the refrigerant compressor is greater than 4 bara.

12. The method according to claim 1, wherein the refrigerant remains entirely in liquid form after the expansion step vi).

13. An apparatus for liquefying and subcooling a stream rich in $CO_2$ containing at least 95 mol % of carbon dioxide comprising a heat exchanger having a hot end and a cold end, a means for sending the stream rich in $CO_2$ at a subcritical pressure greater than 48 bar abs, liquefy through indirect heat exchange in the heat exchanger with an at least partially liquid stream of a refrigerant different from $CO_2$ at a first pressure greater than 4 bara in which the liquid stream of refrigerant different from $CO_2$, vaporizes to form a gaseous stream of refrigerant different from $CO_2$ at the first pressure and the stream rich in $CO_2$ liquefies to form a $CO_2$-rich liquid stream at subcritical pressure, a means for subcooling the $CO_2$-rich liquid stream or a fluid formed by separating the $CO_2$-rich liquid stream, through an exchange of indirect heat in the heat exchanger with at least three other liquid streams rich in $CO_2$ which each vaporize at a different pressure, therefore at at least three different pressure levels, a compressor for compressing the gaseous stream of refrigerant different from $CO_2$ or a stream formed by separating this gaseous stream, the compression taking place in the compressor from the first pressure to a second pressure greater than the first pressure in order to obtaining a gas stream of refrigerant different from $CO_2$ at the second pressure in a single compression step, no gas flow being sent to an intermediate level of the compressor, a means for condensing the gas stream of refrigerant different from $CO_2$ at the second pressure or a current coming from it in order to obtain a liquid stream of ammonia at the second pressure, a means for sending the liquid stream of condensed refrigerant at the second pressure to cool in the exchanger heat and a means for expanding either the cooled liquid stream of refrigerant different from $CO_2$ to the second pressure or a stream formed by separating the liquid stream of refrigerant different from $CO_2$ to the first pressure in order to obtain the at least partially liquid stream of refrigerant different from $CO_2$ up to a single pressure which is the first pressure.

* * * * *